US006348866B1

(12) United States Patent
Arroyo Lopez

(10) Patent No.: US 6,348,866 B1
(45) Date of Patent: Feb. 19, 2002

(54) TRAP FOR ROBBERS

(76) Inventor: Humberto Arroyo Lopez, Norte 87 #459, Col. Electricistas Azcapotzalco, Mexico, D.F. 02060 (MX)

( * ) Notice: Subject to any disclaimer, the term of this patent is extended or adjusted under 35 U.S.C. 154(b) by 0 days.

(21) Appl. No.: 08/816,070

(22) Filed: Mar. 10, 1997

(51) Int. Cl.[7] ..... G08B 23/00

(52) U.S. Cl. ..... 340/573.1; 340/540; 340/541; 109/3; 109/9; 109/21; 109/38

(58) Field of Search ..... 340/523, 541, 340/540, 551, 552, 539, 573.1; 109/6, 7, 8, 3, 31, 17, 5, 21, 9, 21.5, 38

(56) References Cited

U.S. PATENT DOCUMENTS 3,697,972 A * 10/1972 Brown ..... 43/59
4,380,201 A * 4/1983 Dion ..... 109/17
4,461,221 A * 7/1984 Schandle et al. ..... 109/6
5,195,448 A * 3/1993 Sims ..... 109/6

* cited by examiner

*Primary Examiner*—Benjamin C. Lee

(57) ABSTRACT

A trap system for use inside establishments such as banks and other commercial establishments to deter and catch robbers. The system makes use of an anti-bullet, armored cabin or cage having therein an actuation button on the floor for a guard situated therein to activate the closing of the entrance door of the establishment and to activate an alarm in case of a robbery. Like buttons are also placed on floors inside one or more cashiers windows for triggering the alarm and closing the door when pressed.

1 Claim, 3 Drawing Sheets

TRAP FOR ROBBERS

PREFACE

The reason is that nowadays bank and commerces are protected by policemen who are easily disarmed and surrended by assaultants.

My invention is to avoid assaults and to catch the assaultants, by only an unarmed guard whom will be inside an armored cage placed inside the Banks, near the access door.

At a certain moment, either the guard or any employee who pushes a button will activate and the door will slowly close, giving opportunity to the assaultants to run away without the spilling of blood and keeping the bank from being robbed, but at the same time the police will be called just in case that any of the robbers get caught.

SYNOPSIS

Currently banks and business suffer from assaults. Policemen are surprised, caught disarmed and surrended by assaultants. To avoid this assaults to happen and succeed we have invented a conjunction of known elements.

This conjunction is composed (1) of a cage protected by armored material. Placed inside the bank or commerce (2) doors which close automatically whenever a button placed in the proper places inside the bank is pushed (3) the alarm, preferably located above the doors.

DESCRIPTION

Trap is composed by three known elements.

one.—armored cage two.—automatic door three.—alarm and buttons, which will be placed at the cage in the floor, and the cage might be necessary.

The armored cage can be built in one meter by two and can be placed preference at the entrance door, at a height of one meter, according to the requerements, or at ground level.

Figure 1:
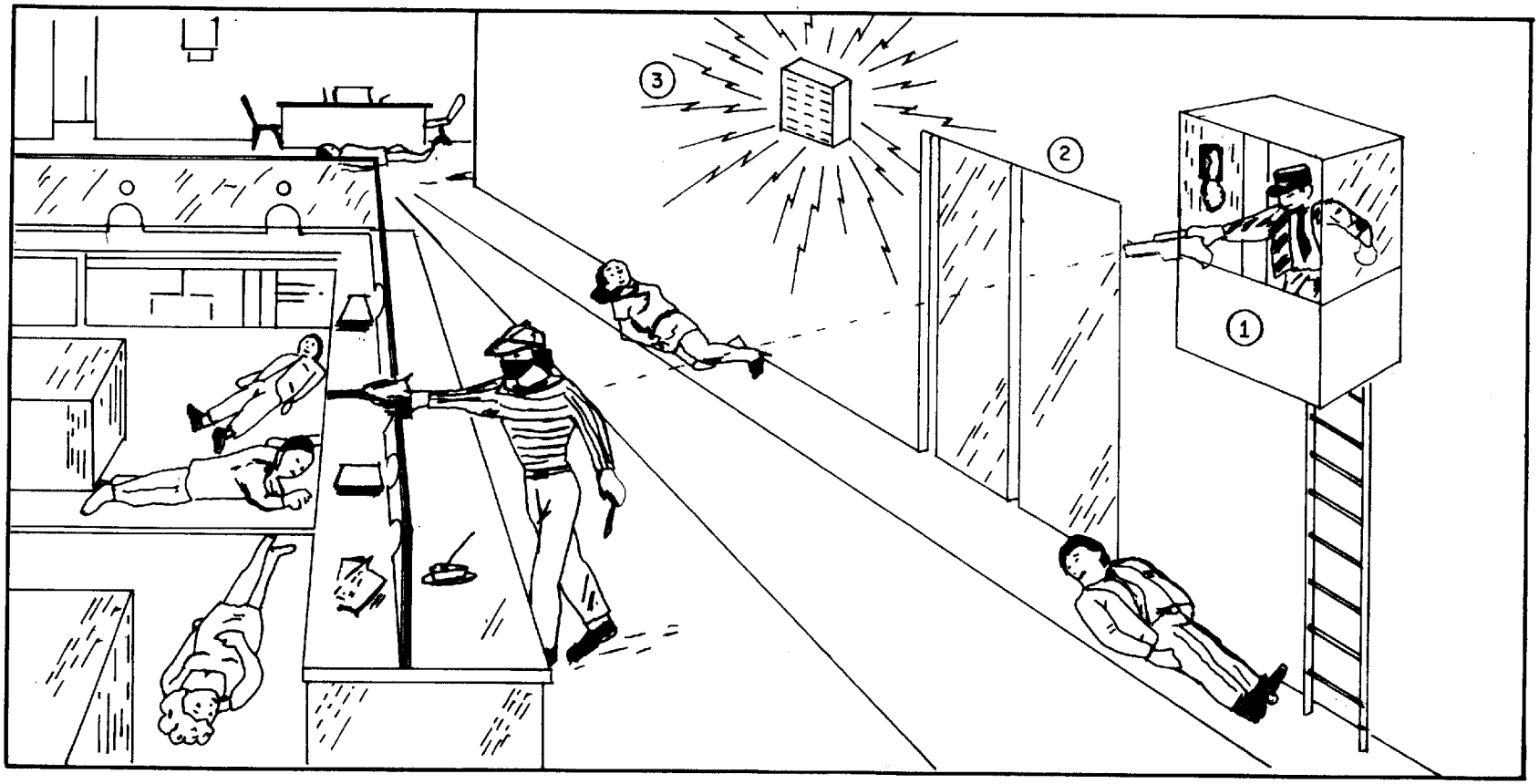

FIG. 1.—it's a front view, composed of:

1.—cage

2.—door

3.—alarm

Figure 2:
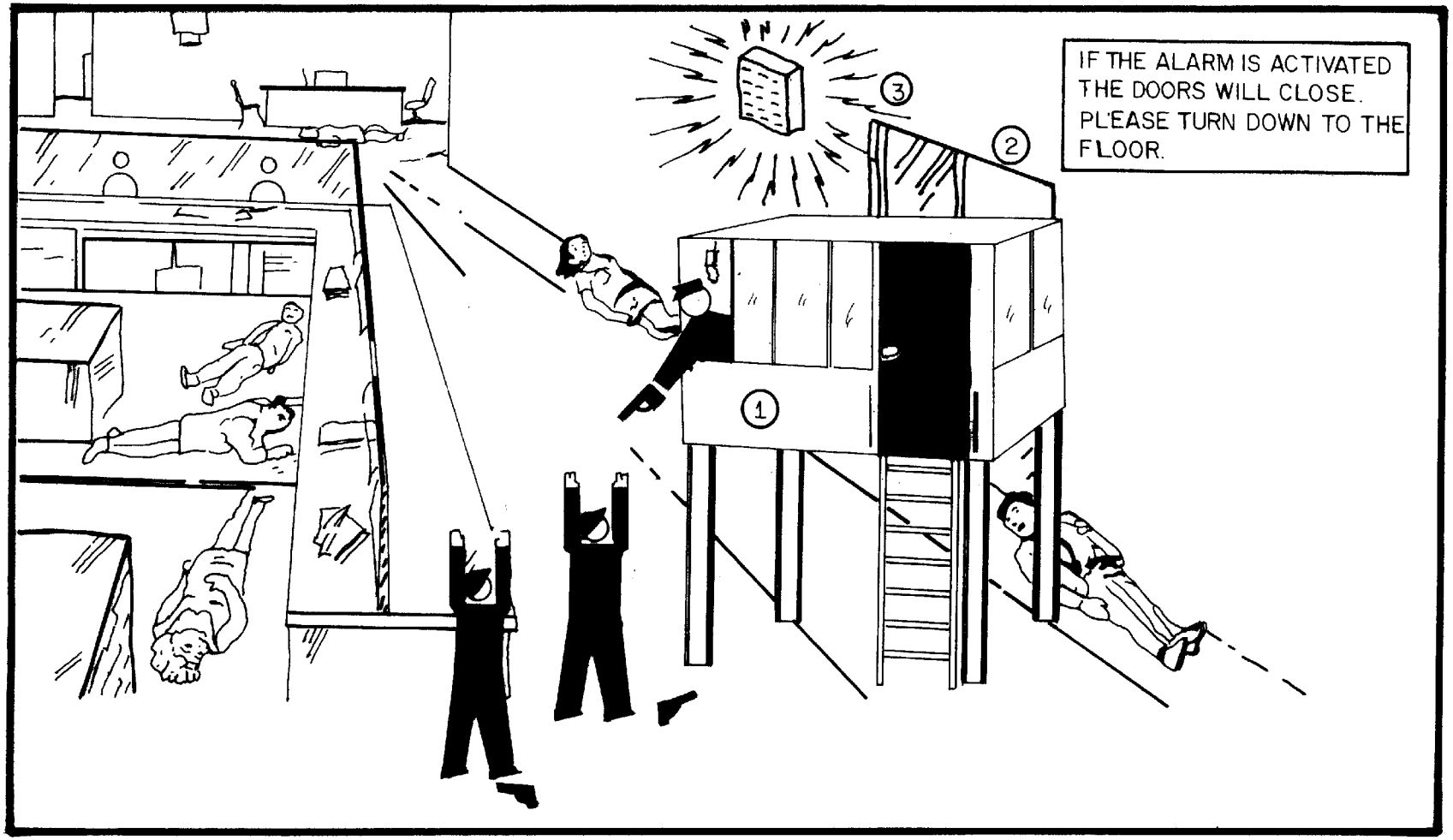

FIG. 2.—it's a front view, composed of:

1.—cage

2.—door

3.—alarm

Figure 3:
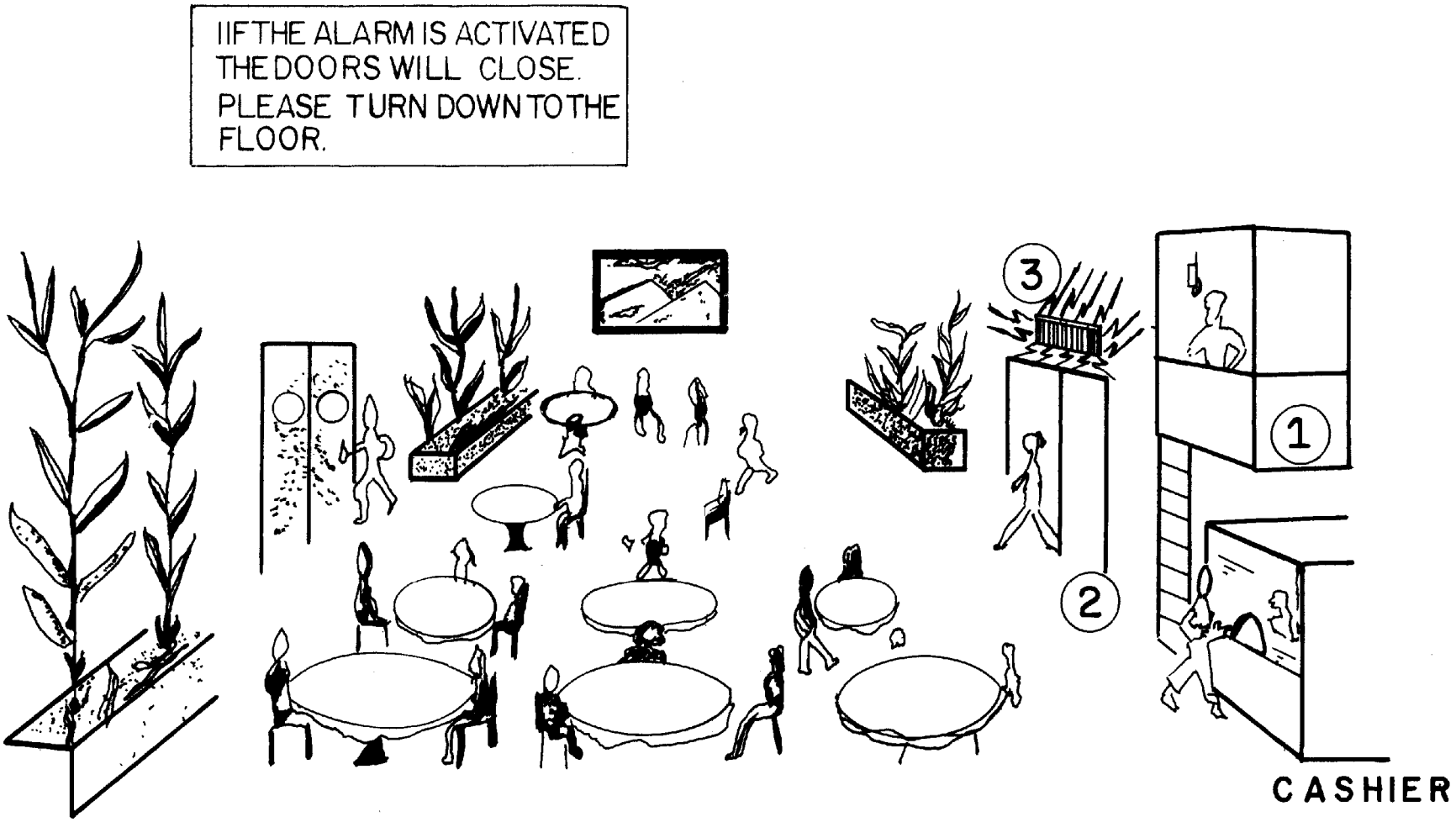

FIG. 3.—it's a front view, composed of:

1.—cage

2.—door

3.—alarm

As in real life changes or modifications might be suggested, these changes must be considered as a part of the copyright for the invention itself.

Having my invention described, and considering it as novelty, therefore I claim as my exclusive property, the elements considered within the following clause:

1. A trap system for use inside establishments including banks and other commercial establishments to deter and catch robbers, comprising:

an anti-bullet cabin for housing a guard, said cabin placed inside an establishment near an entrance, said cabin located either at floor-level in the establishment or at a height of about one meter above the floor;

an alarm;

an automatically operated door at said entrance;

buttons placed on the floor of said cabin and on floors inside one or more cashier's windows for triggering said alarm and closing said door when pressed.

* * * * *